US007329091B2

(12) United States Patent
Yan et al.

(10) Patent No.: US 7,329,091 B2
(45) Date of Patent: Feb. 12, 2008

(54) HEAT DISSIPATION FANS AND HOUSINGS THEREFOR

(75) Inventors: Cheng-Wei Yan, Taoyuan Hsien (TW); Tsu-Liang Lin, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 58 days.

(21) Appl. No.: 10/992,340

(22) Filed: Nov. 19, 2004

(65) Prior Publication Data

US 2006/0039784 A1 Feb. 23, 2006

(30) Foreign Application Priority Data

Aug. 18, 2004 (TW) ..... 93124813 A

(51) Int. Cl.
*F03B 3/16* (2006.01)

(52) U.S. Cl. ..... 415/191; 415/208.2; 415/211.2; 415/220

(58) Field of Classification Search ..... 415/185, 415/191, 208.2, 209.3, 209.4, 210.1, 211.2, 415/218.1, 219.1, 220, 222, 223; 416/247 R; 417/354, 423.1

See application file for complete search history.

(56) References Cited

U.S. PATENT DOCUMENTS

| | | | | |
|---|---|---|---|---|
| 2,441,239 | A * | 5/1948 | Flanders | 415/207 |
| 2,661,147 | A * | 12/1953 | Anderson | 415/209.3 |
| 4,482,302 | A * | 11/1984 | Grignon | 417/354 |
| 4,554,473 | A * | 11/1985 | Muller | 310/67 R |
| 4,895,489 | A * | 1/1990 | Kohama et al. | 415/218.1 |
| 6,017,191 | A * | 1/2000 | Harmsen | 416/247 R |
| 6,244,818 | B1 * | 6/2001 | Chang | 415/208.2 |
| 6,394,768 | B1 * | 5/2002 | Fukuda et al. | 417/423.15 |
| 6,561,762 | B1 * | 5/2003 | Horng et al. | 415/211.1 |
| D483,109 | S * | 12/2003 | Chang et al. | D23/411 |
| 6,663,342 | B2 * | 12/2003 | Huang et al. | 415/121.2 |
| 6,979,177 | B2 * | 12/2005 | Lin et al. | 416/181 |
| 7,011,504 | B2 * | 3/2006 | Seo et al. | 416/247 R |
| 7,063,504 | B2 * | 6/2006 | Huang et al. | 415/165 |
| 2002/0094271 | A1 | 7/2002 | Yeuan et al. | |
| 2005/0002784 | A1 * | 1/2005 | Li et al. | 415/220 |
| 2005/0186072 | A1 * | 8/2005 | Ku et al. | 415/220 |
| 2006/0002790 | A1 * | 1/2006 | Lu et al. | 415/220 |

FOREIGN PATENT DOCUMENTS

| | | | | |
|---|---|---|---|---|
| CN | 1230628 | C | 12/2005 | |
| DE | 201 15 410 | U1 | 1/2002 | |
| DE | 202 14 973 | U1 | 1/2003 | |
| FR | 2386706 | A * | 11/1978 | 415/211.2 |
| TW | 540653 | | 7/2003 | |
| WO | WO-01/96745 | A1 * | 12/2001 | |

* cited by examiner

*Primary Examiner*—Edward K. Look
*Assistant Examiner*—Dwayne J White
(74) *Attorney, Agent, or Firm*—Birch, Stewart, Kolasch & Birch, LLP

(57) ABSTRACT

A heat dissipation fan and a housing thereof. The heat dissipation fan includes a housing and a plurality of blades. The housing includes an outer frame, a base, and a plurality of air-guiding elements. The base is disposed in the outer frame, supporting the blades thereon. The air-guiding elements are disposed between the base and the outer frame, having a first curved surface, a second curved surface, and a bottom surface.

28 Claims, 10 Drawing Sheets

HEAT DISSIPATION FANS AND HOUSINGS THEREFOR

BACKGROUND

Electronic devices generally produce heat during operation, and thus, heat-dissipating devices or fan assemblies are required. As the demand for heat-dissipation increases, fans must provide enhanced performance.

As shown in FIG. 1, a conventional axial flow fan includes a casing 90, a stator 91, and an impeller 93. The stator 91 is disposed in the casing 90. The impeller 93 includes a rotary shaft 94 inserted in an axial hole of the stator 91 and supported by bearings 92. When the impeller 93 rotates, airflow is directed to an outlet of the casing 90 by blades 95 of the impeller 93. A plurality of ribs 96 are disposed at the outlet of the casing 90. The ribs 96 are substantially a quarter of a circle in cross section, as shown in FIG. 2. The airflow produced by the impeller 93 is blocked by the ribs 96, resulting in different directions of airflow as shown by the arrows in FIG. 2. Noise is produced due to air turbulence near the ribs 96, and the air pressure at the outlet is reduced.

SUMMARY

Heat dissipation fans and housings thereof are provided. An exemplary embodiment of a housing of a heat dissipation fan comprises an outer frame, a base, and a plurality of air-guiding elements. The base is disposed in the outer frame. The air-guiding elements, disposed between the base and the outer frame, comprise a first curved surface, a second curved surface, and a bottom surface.

Further provided is another housing comprising an outer frame, a base, and a plurality of air-guiding elements. The base is disposed in the outer frame. The air-guiding elements, disposed between the base and the outer frame, comprise a first sloped surface and a second sloped surface, connected thereto. The sloped surfaces are arch, convex, concave, or sloped at different angles.

An exemplary embodiment of a heat dissipation fan comprises an outer frame, an impeller, a base, and a plurality of air-guiding elements. The impeller comprises a hub and a plurality of blades encircling the hub. The base is disposed in the outer frame. The air-guiding elements, disposed between the base and the outer frame, comprise a first curved surface and a second curved surface.

The blades comprise an inner edge lower than a top surface of the hub. The hub comprises a curved upper edge.

The heat-dissipation device further comprises a metal shell with a plurality of holes defined therein, and the hub comprises an engaging element engaged in the holes such that the hub is telescoped outside the metal shell.

The first curved surface and the second curved surface form different acute angles relative to a plane of the bottom surface, respectively, between 5° and 60°. Also, the first curved surface and the second curved surface have different curvatures.

The air-guiding elements further comprise a horizontal bottom surface. The curved surfaces are arch, convex, concave, or sloped at different angles.

The air-guiding elements are incomplete stator blades with a cross section area greater than or equal to one-third of the cross section area of the blades. The cross section area of the air-guiding elements may be less than that of the blades. The height of the air-guiding elements is substantially one-third to half that of the blades.

The outer frame comprises an outwardly extended portion, located at an outlet or an inlet thereof to increase air volume. The air-guiding elements are connected between the extended portion and the base. Each of the air-guiding elements comprises a fixed end and a free end. The fixed end is connected to the base, and the free end extends in the direction of the extended portion. Alternatively, the fixed end may be connected to the extended portion, and the free end extends in the direction of the base. Each of the air-guiding elements can comprise fixed ends connected to the extended portion and free ends extending in the direction of the base, and others of the air-guiding elements comprise fixed ends connected to the base and free ends extending in the direction of the extended portion.

A cross section of the air-guiding elements gradually increases or decreases from the base to the extended portion.

Additionally, the outer frame, the casing, and the air-guiding elements are integrally formed, as a monolithic piece.

The base comprises a plurality of reinforced structures to increase strength thereof.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the subsequent detailed description and the accompanying drawings, which are given by way of illustration only, and thus are not limitative of the present invention, and wherein:

FIG. 5 is a schematic view showing arrangement of an air-guiding element and a blade;

DETAILED DESCRIPTION

Figure 3:
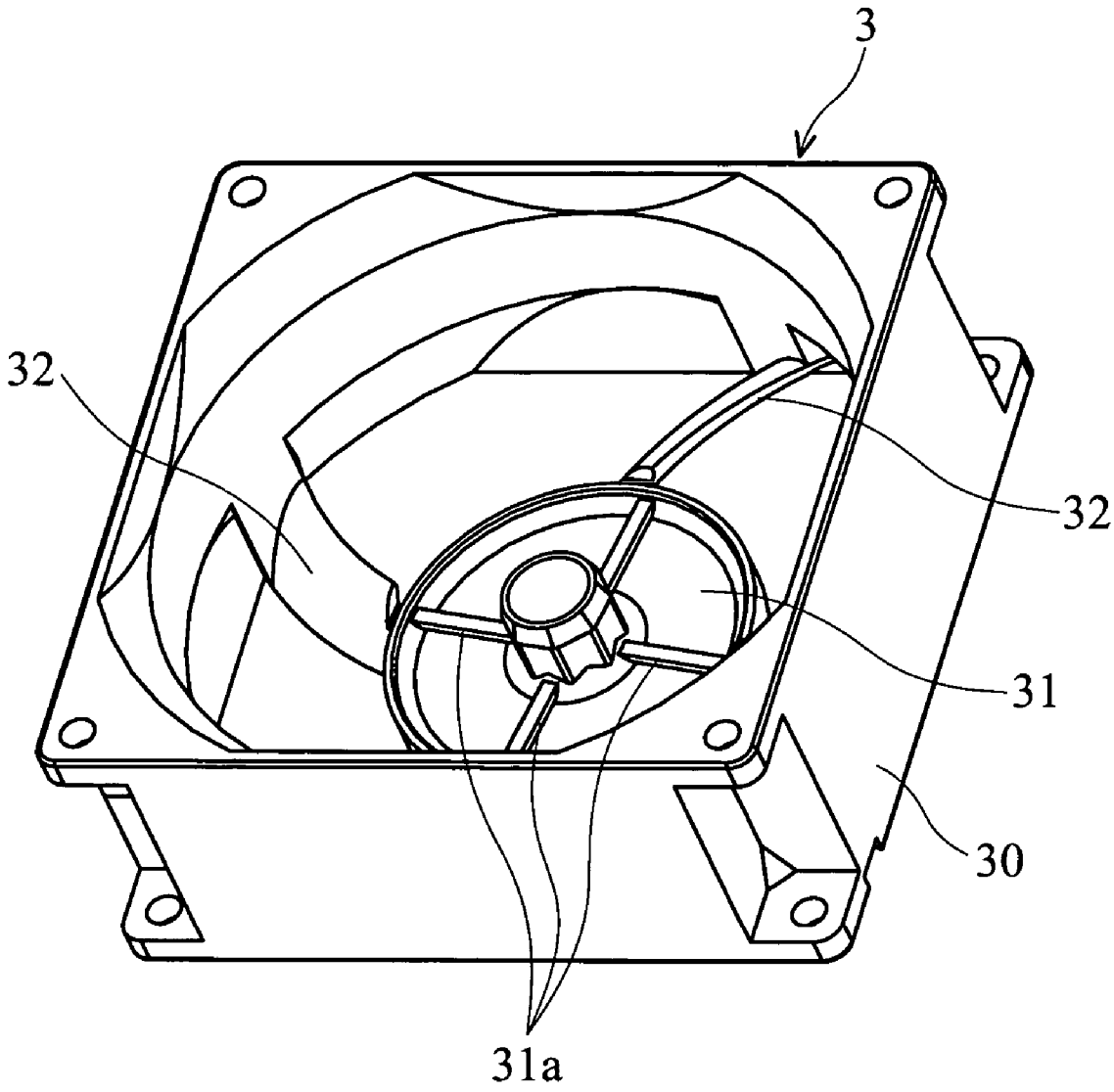
FIG. 3 is a perspective view of an embodiment of a housing of a heat dissipation fan.

Heat dissipation fans and housings thereof are provided. FIG. 3 is a perspective view of an embodiment of a housing 3 of a heat dissipation fan. The housing 3 includes an outer frame 30, a base 31, and a plurality of air-guiding elements 32. The base 31 is disposed in the outer frame 30 to support blades (not shown) of an impeller (not shown) of the heat dissipation fan. The air-guiding elements 32 are disposed between the base 31 and the outer frame 30 in the vicinity of an outlet. The air-guiding elements 32 can also be disposed at an inlet or at both the inlet and the outlet of the housing. The outer frame 30, while square as shown in FIG. 3, can also be rectangular or circular. The outer frame 30, the base 31, and the air-guiding elements 32 can be integrally formed as a monolithic piece by injection molding using materials such as plastic or metal. The base 31 can have a plurality of reinforced structures 31*a* to increase strength thereof.

Figure 4A:
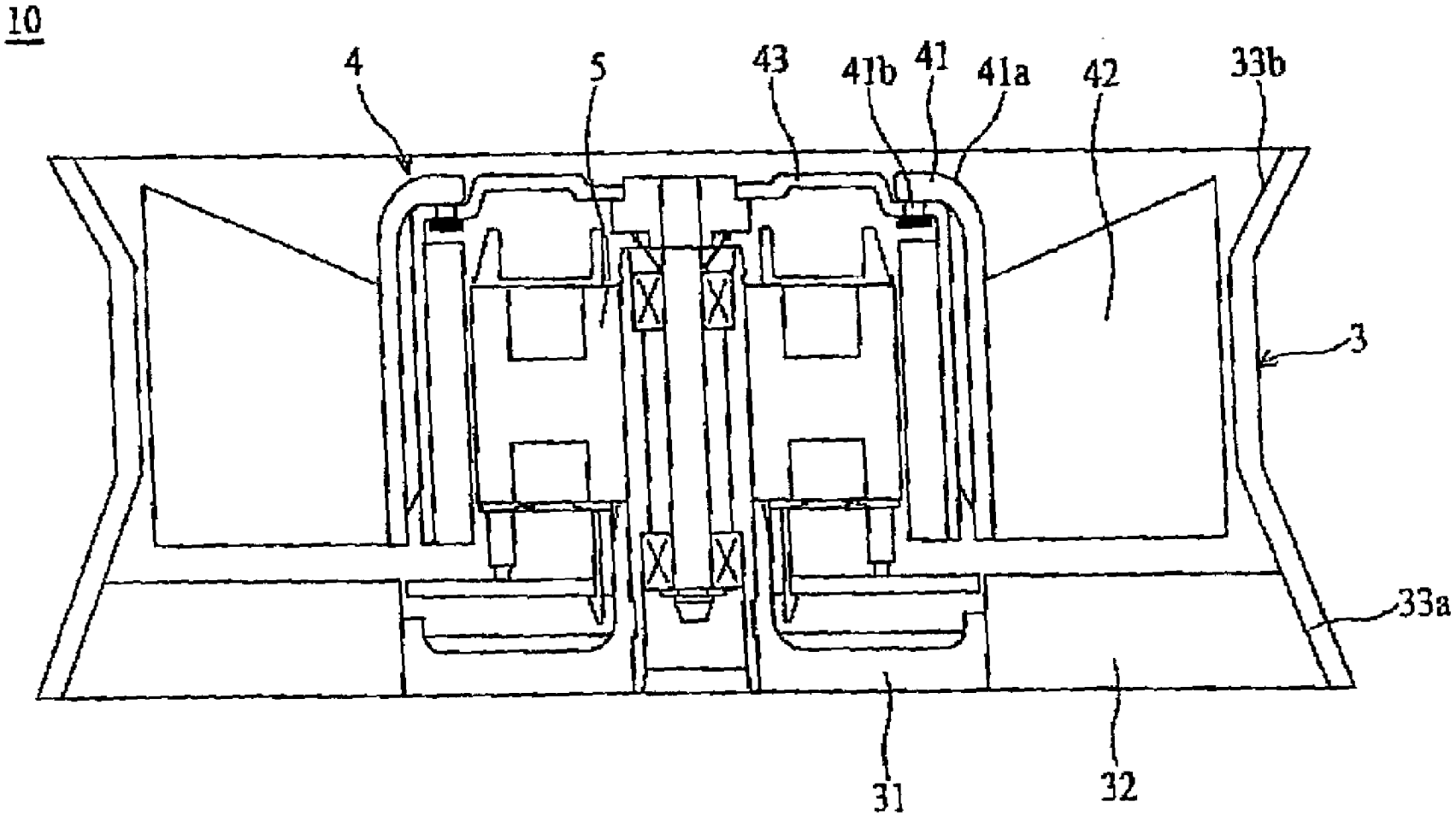
FIGS. 4A to 4C are sectional views of an embodiment of a heat dissipation fan.
Figure 4B:
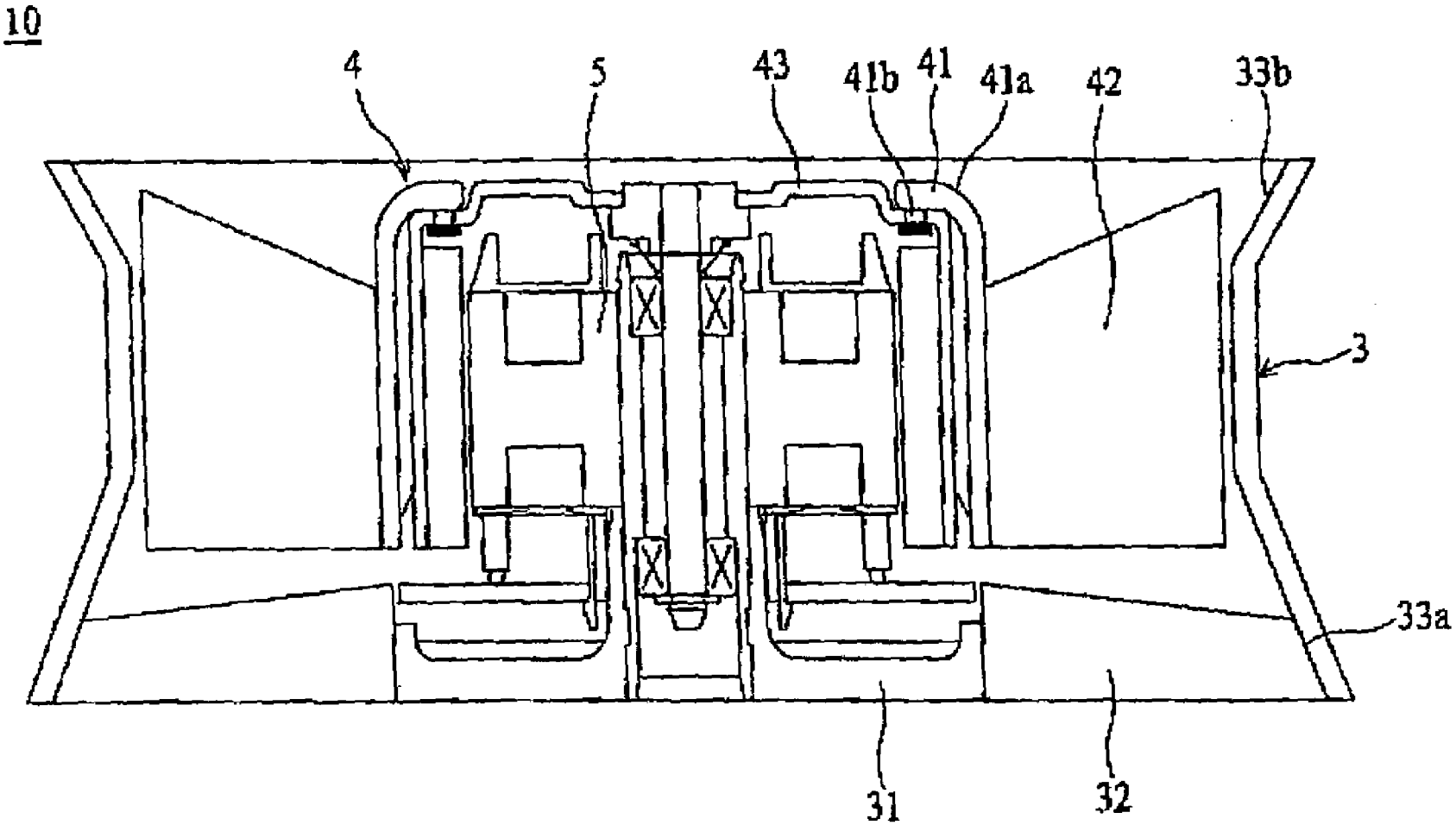
Figure 4C:
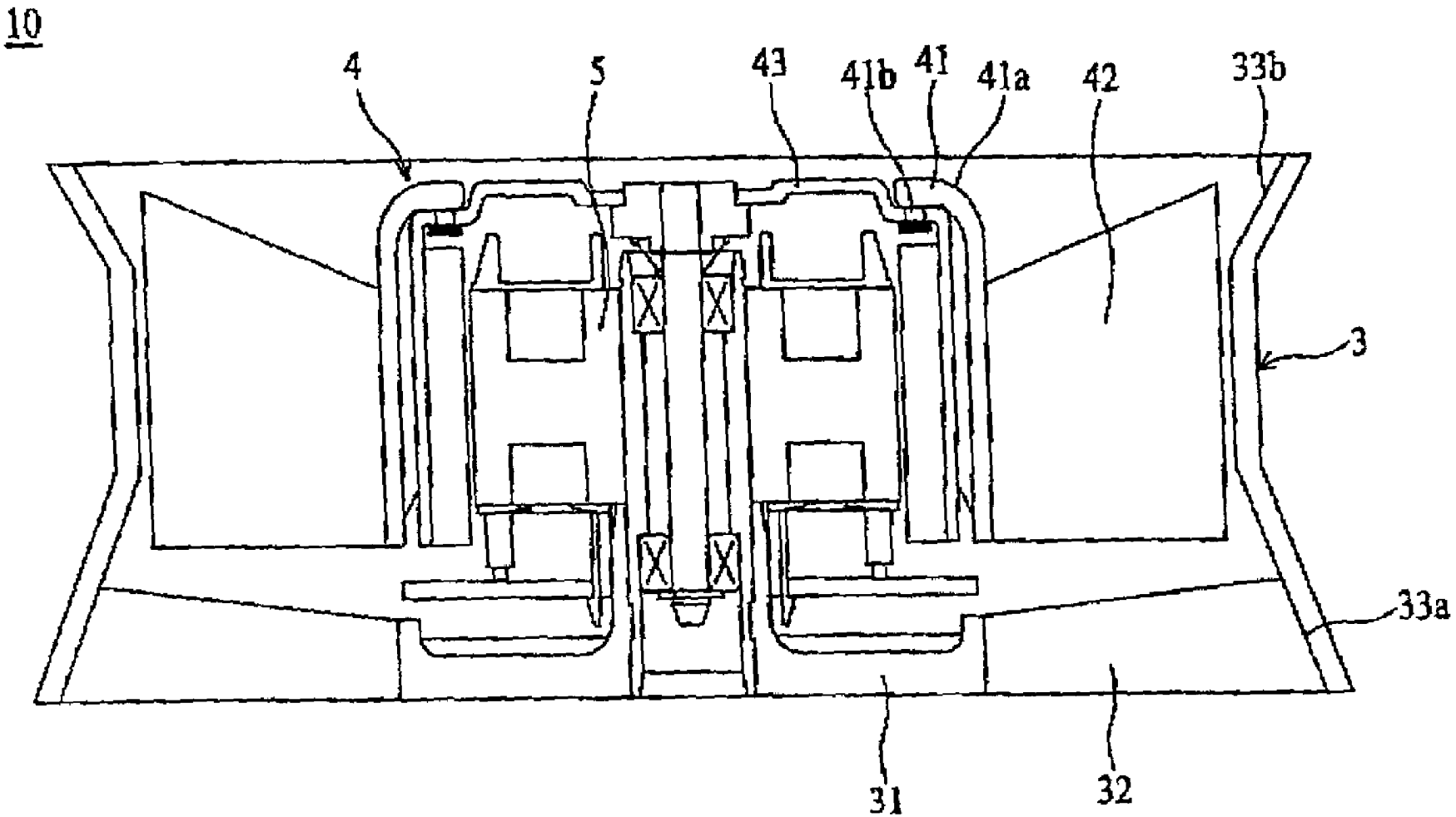

As shown in FIGS. 4A, 4B and 4C, the heat dissipation fan 10 includes an impeller 4. The impeller 4 has a hub 41 and a plurality of blades 42 encircling the hub 41. Each of the blades 42 has an inner edge lower than a top surface of the hub 41. The hub 41 has a top edge with curved structure 41*a* such that airflow is smoothly guided to the blades 42. The heat dissipation fan 10 further includes a metal shell 43 with a plurality of holes defined therein. A top portion of the hub 41 has an engaging element 41*b* engaged in the holes of the metal shell 43 to telescope the hub 41 outside the metal shell 43. The holes of the metal shell 43 are not shown, since the engaging element 41*b* is disposed therein. The heat dissipation fan 10 further includes a driving device 5 disposed in the metal shell 43 or the hub 41 to rotate the impeller 4, producing airflow.

Figure 5A:
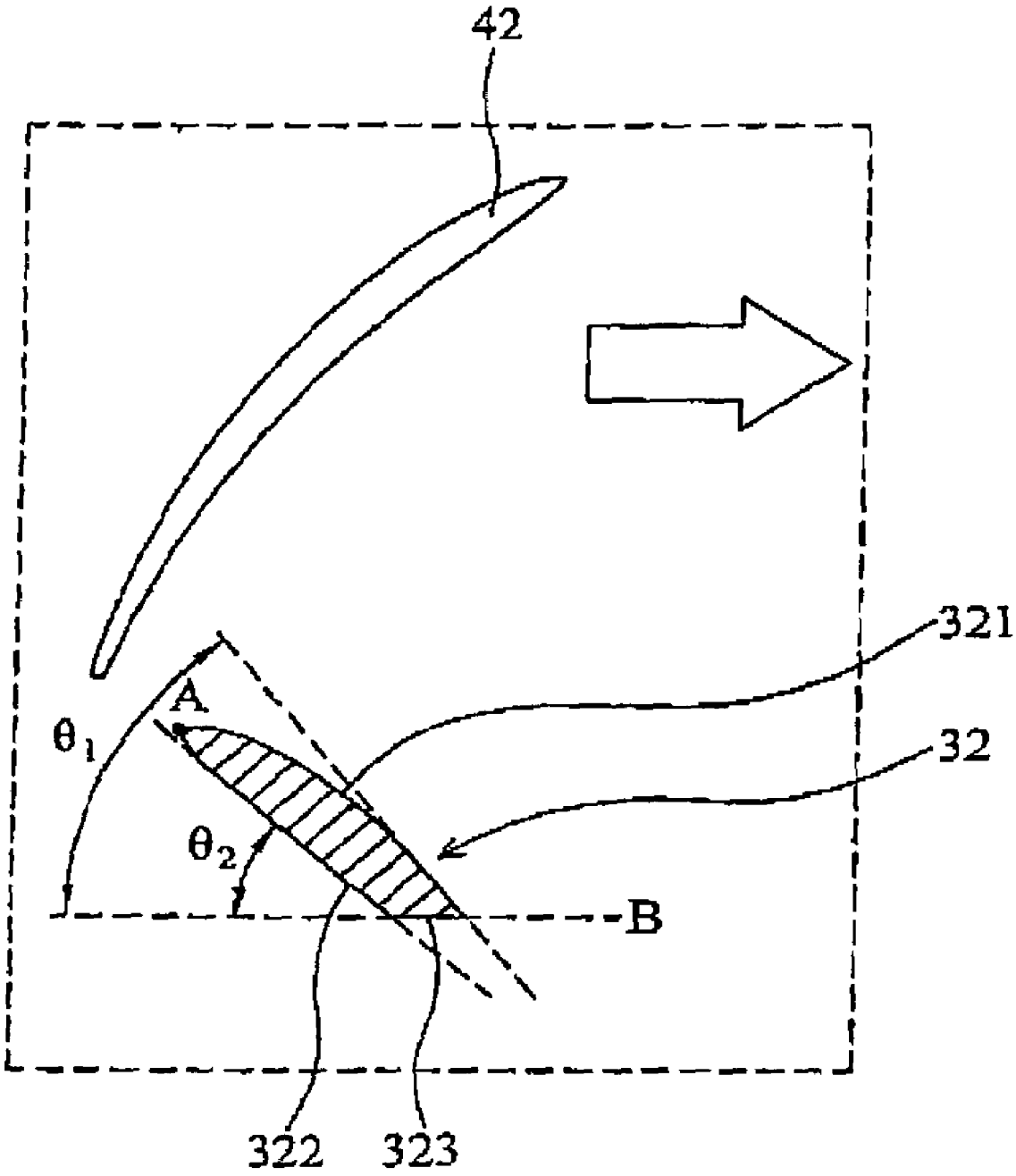
FIGS. 5A to 5B are schematic views showing arrangement of an air-guiding element and a blade.
Figure 5B:
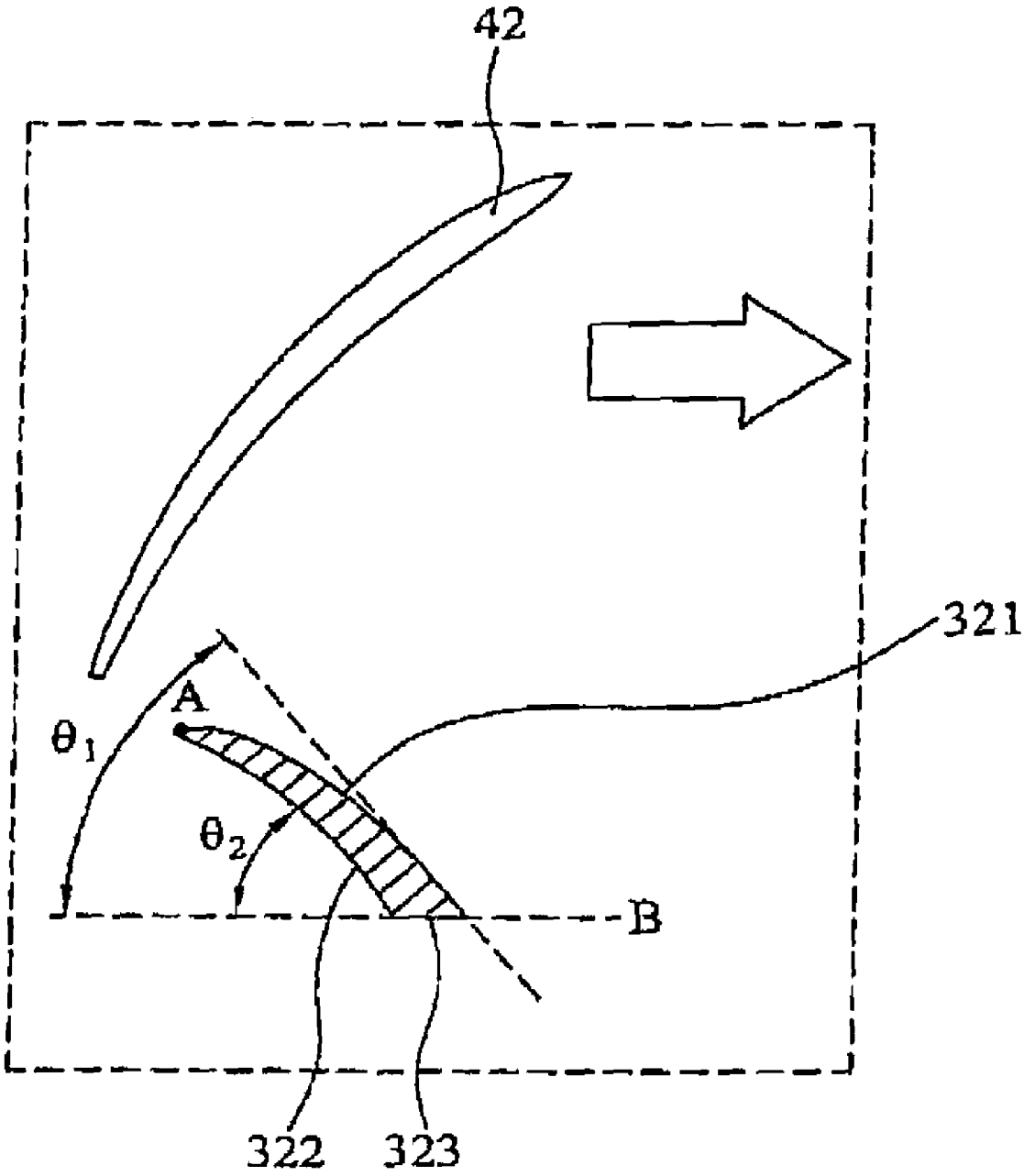

As shown in FIGS. 5A and 5B, each of the air-guiding elements 32 has a first curved surface 321, a second curved surface 322, and a horizontal bottom surface 323. The first curved surface 321 is located on the windward side, forming an inclined angle $\theta_1$ relative to a plane B of the horizontal bottom surface 323, shown by a dotted line. The second curved surface 322 is located at the opposite side of incoming airflow. The second curved surface 322 forms an inclined angle θrelative to a plane B of the bottom surface 323. Note that the angles $\theta_1$ and $\theta_2$ are different. The angles are preferably acute angles between 5° and 60°. The first curved surface 321 and the second curved surface 322 are arch, convex, concave or sloped at an angle and can intersect at a point A in the vicinity of an end of the blade 42 such that airflow through the blades 42 is transferred to static pressure. Thus, air pressure of the heat dissipation fan is increased.

As shown in FIG. 5, each of the air-guiding elements 32 has a first curved surface 321, a second curved surface 322, and a horizontal bottom surface 323. The first curved surface 321 is located on the windward side, forming an inclined angle $\theta_1$ relative to a plane B of the horizontal bottom surface 323, shown by a dotted line. The second curved surface 322 is located at the opposite side of incoming airflow. The second curved surface 322 forms an inclined angle $\theta_2$ relative to a plane B of the bottom surface 323. Note that the angles $\theta_1$ and $\theta_2$ are different. The angles are preferably acute angles between 5° and 60°. The first curved surface 321 and the second curved surface 322 are arch, convex, concave, or sloped at an angle and can intersect at a point A in the vicinity of an end of the blade 42 such that airflow through the blades 42 is transferred to static pressure. Thus, air pressure of the heat dissipation fan is increased.

The air-guiding elements 32 are incomplete stator blades with cross section area greater than or equal to one-third of the cross section area of the blades 42. Alternatively, the cross section area of the air-guiding elements 32 is less than that of the blades 42. Namely, if the blades 42 are wing-shaped, the air-guiding elements 32 have a similar wing-shape with end portions thereof being cut off. Thus, the height of the air-guiding elements 32 is substantially one-third to half that of the blades 42.

Figure 6A:
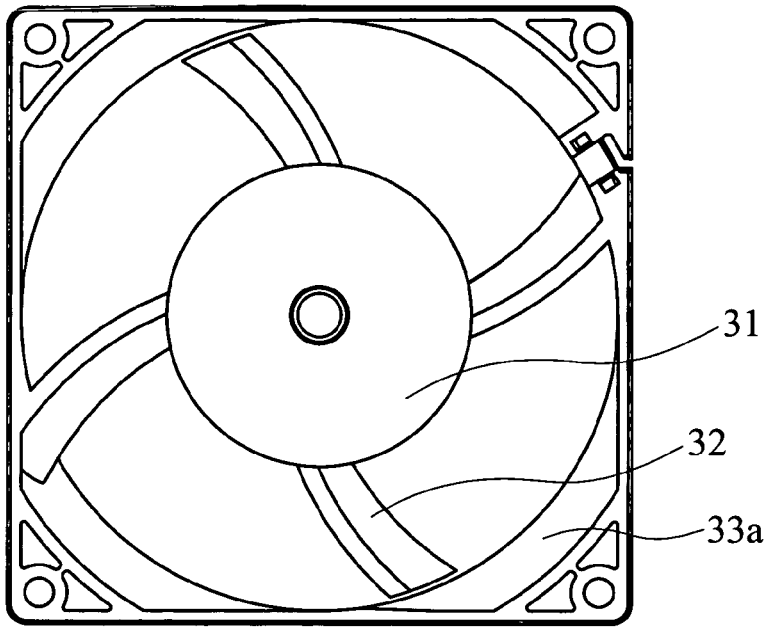
FIGS. 6A and 6B are bottom views of another two embodiments of housings of heat dissipation fans.
Figure 6B:
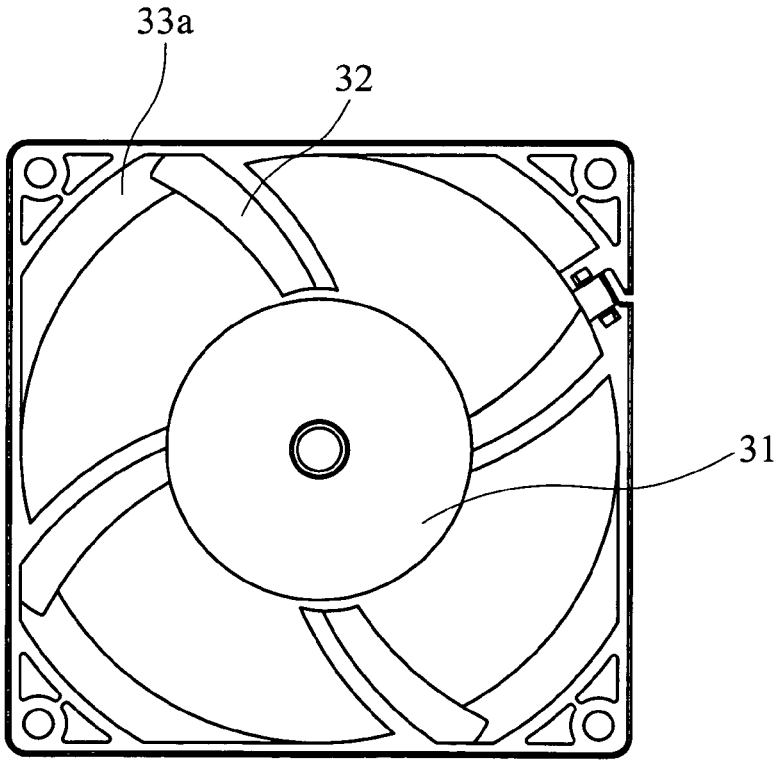

As shown in FIGS. 4A, 4B and 4C, the outer frame 30 includes an outwardly extended portion 33*a*, located at an outlet, and another outwardly extended portion 33*b* located at an inlet thereof to increase air volume. The air-guiding elements 32 are connected between the extended portion 33*a* and the base 31. Note that the connection therebetween is not limited. For example, some of the air-guiding elements 32 have a fixed end connected to the base 31 and a free end extending in the direction of the extended portion 33*a*, as shown in FIG. 6A. Alternatively, some of the air-guiding elements 32 have a fixed end connected to the extended portion 33*a* and a free end extending in the direction of the base 31, as shown in FIG. 6B. Alternatively, the air-guiding elements 32 can be divided into two portions, one portion respectively having a fixed end connected to the extended portion 33*a* and a free end extending in the direction of the base 31, and the other portion respectively having a fixed end connected to the base 31 and a free end thereof extending in the direction of the extended portion 33*a*. In addition, the cross section of the air-guiding elements 32 is constant or can gradually increase or decrease from the base 31 to the extended portion 33*a*. The quantities of the air-guiding elements 32 can be less than those of the blades 42. The quantities of the air-guiding elements 32 can be less than those of the blades 42.

Figure 1:
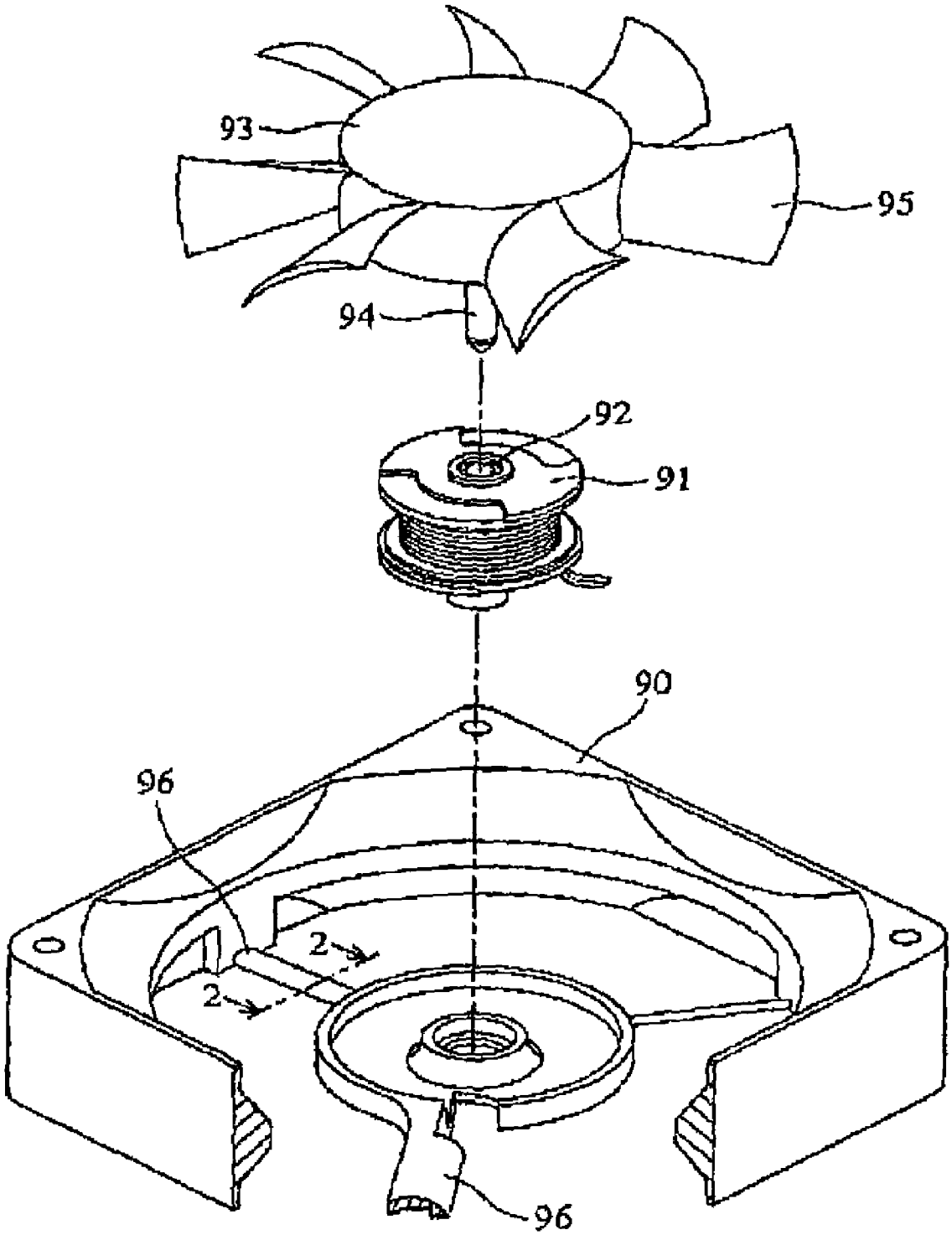
FIG. 1 (PRIOR ART)
FIG. 1 is a schematic exploded view of a conventional fan.
Figure 2:
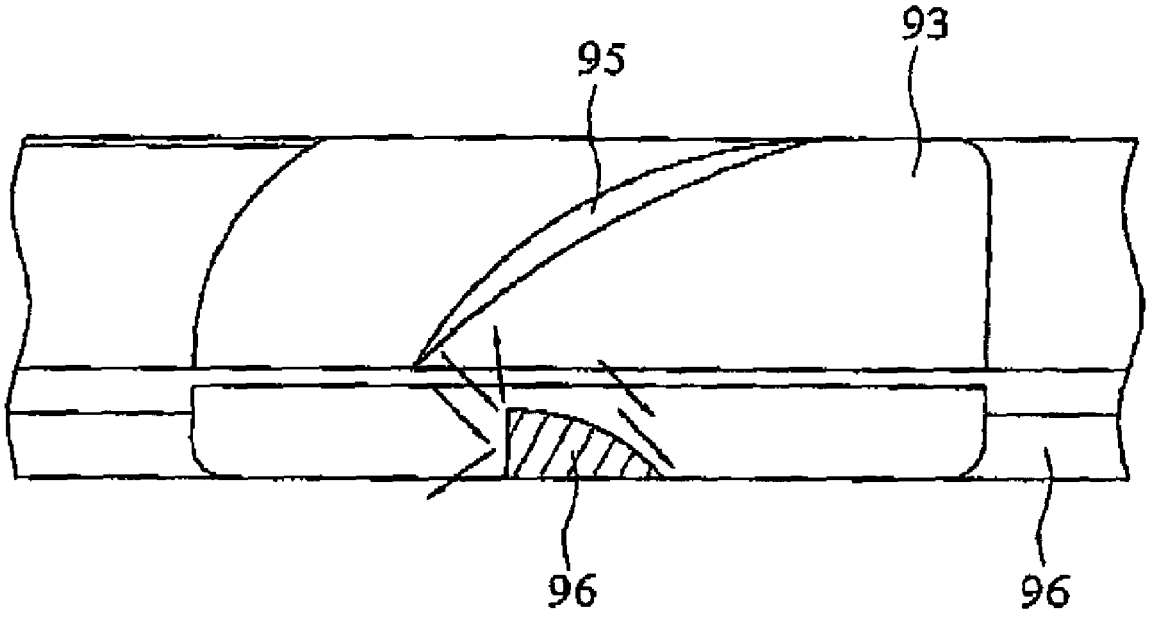
FIG. 2 (PRIOR ART)
FIG. 2 is a sectional view of FIG. 1 along line 2-2.
Figure 7:
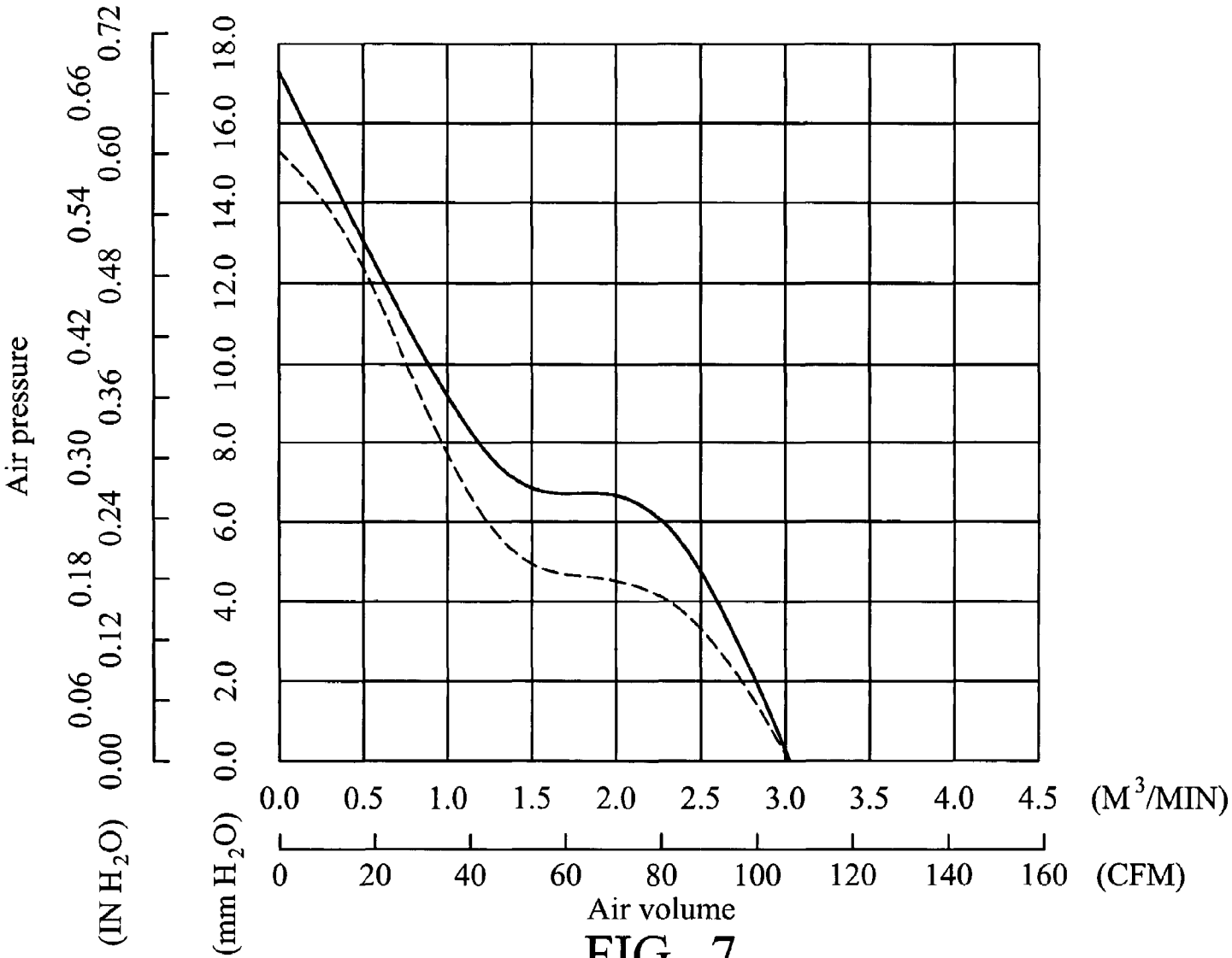
FIG. 7 is a plot showing the relationship between air pressure and air volume of an embodiment of a heat dissipation fan, compared with a conventional fan.

FIG. 7 is a plot showing the relationship between air pressure and air volume of the heat dissipation fan of FIGS. 3 to 5, compared with a conventional fan of FIG. 1. The dotted-line curve represents the plot of the conventional fan, and the solid-line curve represents that of the heat dissipation fan with the air-guiding elements of the present invention. It can be seen that the air-guiding elements can greatly increase air pressure while reducing noise level. In addition, the air-guiding elements of the present invention can also improve the performance of speed control of the axial-flow fan.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A housing for a heat dissipation fan, comprising:

an outer frame;

a base disposed in the outer frame; and a plurality of air-guiding elements disposed between the base and the outer frame and having a first curved surface, a second curved surface, and a flat bottom surface, wherein the first curved surface and the second curved surface have different curvatures.

2. The housing as claimed in claim 1, wherein the first curved surface and the second curved surface are arch, convex, concave or sloped.

3. The housing as claimed in claim 1, wherein the first curved surface and the second curved surface form an acute angle relative to a plane of the flat bottom surface, respectively.

4. The housing as claimed in claim 1, wherein the first curved surface and the second curved surface form an acute angle relative to a plane of the flat bottom surface, respectively, substantially between 5° and 6°.

5. The housing as claimed in claim 1, wherein the air-guiding elements are incomplete stator blades.

6. The housing as claimed in claim 1, wherein a cross section area of the air-guiding elements is greater than or equal to one-third of a cross section area of blades of the heat dissipation fan.

7. The housing as claimed in claim 1, wherein a cross section area of the air-guiding elements is less than that of blades of the heat dissipation fan.

8. The housing as claimed in claim 1, wherein the height of the air-guiding elements is substantially one-third to half of the height of blades of the heat dissipation fan.

9. A housing for a heat dissipation fan, comprising:

an outer frame having an outwardly extended portion located at an outlet thereof;

a base disposed in the outer frame; and a plurality of air-guiding elements disposed between the base and the outwardly extended portion and having a first sloped surface and a second sloped surface.

10. The housing as claimed in claim 9, wherein the first sloped surface and the second sloped surface are arch, convex, or concave, or wherein the first sloped surface and the second sloped surface are sloped at different angles.

11. A heat dissipation fan, comprising:

an outer frame;

an impeller having a hub and a plurality of blades encircling the hub;

a base disposed in the outer frame for supporting the impeller; and a plurality of air-guiding elements, disposed between the base and the outer frame, having a first curved surface, a second curved surface and a flat bottom surface, wherein the first curved surface and the second curved surface have different curvatures.

12. The heat dissipation fan as claimed in claim 11, wherein the blades have an inner edge lower than a top surface of the hub.

13. The heat dissipation fan as claimed in claim 11, further comprising a metal shell with a plurality of holes defined therein, the hub having an engaging element engaged in the holes such that the hub is telescoped outside the metal shell.

14. The heat dissipation fan as claimed in claim 13, further comprising a driving device disposed in the metal shell or the hub to rotate the blades and produce airflow.

15. The heat dissipation fan as claimed in claim 11, wherein the hub has a curved upper edge.

16. The heat dissipation fan as claimed in claim 11, wherein the first curved surface and the second curved surface form two different acute angles relative to the flat bottom surface of each air-guiding element, respectively.

17. The heat dissipation fan as claimed in claim 11, wherein the first curved surface and the second curved surface are arch, convex, concave, or sloped.

18. The heat dissipation fan as claimed in claim 11, wherein the air-guiding elements are incomplete stator blades.

19. The heat dissipation fan as claimed in claim 11, wherein the cross section area of the air-guiding elements is greater than or equal to one-third of the cross section area of the blades.

20. The heat dissipation fan as claimed in claim 11, wherein the cross section area of the air-guiding elements is less than that of the blades.

21. The heat dissipation fan as claimed in claim 11, wherein the height of the air-guiding elements is substantially one-third to half of the height of the blades.

22. The heat dissipation fan as claimed in claim 11, wherein the outer frame has an outwardly extended portion, located at an outlet or an inlet thereof to increase air volume.

23. The heat dissipation fan as claimed in claim 22, wherein the air-guiding elements have fixed ends connected to the base and free ends extending in the direction of the outwardly extended portion.

24. The heat dissipation fan as claimed in claim 22, wherein the air-guiding elements have fixed ends connected to the outwardly extended portion and free ends extending in the direction of the base.

25. The heat dissipation fan as claimed in claim 22, wherein some of the air-guiding elements have fixed ends connected to the outwardly extended portion and free ends extending in the direction of the base, and others of the air-guiding elements have fixed ends connected to the base and free ends extending in the direction of the outwardly extended portion.

26. The heat dissipation fan as claimed in claim 22, wherein the cross section of the air-guiding elements gradually increases or decreases from the base to the outwardly extended portion.

27. The heat dissipation fan as claimed in claim 11, wherein the outer frame, the base, and the air-guiding elements are integrally formed as a monolithic piece.

28. The heat dissipation fan as claimed in claim 11, wherein the base has a plurality of reinforced structures.

* * * * *